US008841984B1

(12) United States Patent
Wambsganss

(10) Patent No.: US 8,841,984 B1
(45) Date of Patent: Sep. 23, 2014

(54) PLANAR TRANSFORMER WITH IMBALANCED COPPER THICKNESS

(75) Inventor: Warren J. Wambsganss, Van Horne, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 45 days.

(21) Appl. No.: 13/361,825

(22) Filed: Jan. 30, 2012

(51) Int. Cl.
*H01F 5/00* (2006.01)

(52) U.S. Cl.
USPC ..... 336/200

(58) Field of Classification Search
USPC ..... 336/65, 83, 200, 232
See application file for complete search history.

(56) References Cited

U.S. PATENT DOCUMENTS

| | | | | |
|---|---|---|---|---|
| 6,320,490 | B1 * | 11/2001 | Clayton | 336/180 |
| 7,417,875 | B2 * | 8/2008 | Chandrasekaran et al. | 363/17 |
| 7,427,910 | B2 * | 9/2008 | Mehrotra et al. | 336/200 |
| 7,554,430 | B2 * | 6/2009 | Mehrotra et al. | 336/200 |
| 7,932,799 | B2 * | 4/2011 | Loef et al. | 336/200 |

* cited by examiner

*Primary Examiner* — Tuyen Nguyen
(74) *Attorney, Agent, or Firm* — Donna P. Suchy; Daniel M. Barbieri

(57) ABSTRACT

The invention provided in one embodiment is a transformer, comprising: at least one host board comprising internal windings, which comprise copper; external windings, which comprise copper and are connected externally, with respect to the host board, and in parallel to the internal windings, wherein the external windings are thicker than the internal windings.

14 Claims, 6 Drawing Sheets a b

PLANAR TRANSFORMER WITH IMBALANCED COPPER THICKNESS

All publications, patents, and patent applications cited in this Specification are hereby incorporated by reference in their entirety.

BACKGROUND

Planar transformers are commonly constructed using windings in printed circuit boards, metal stampings, or a combination of the two. Interleaving between primary windings and secondary windings is performed to reduce leakage inductance. The windings on different layers are connected in combinations of series and parallel connections to achieve the correct turns ratio.

Traditionally, the windings connected in parallel are of equal copper weight, equally distributing the current between the windings. Such a design can encounter several drawbacks. For example, in the case of a medium to high power transformer, this type of construction needs circuit boards that contain many layers of heavy copper. As a result, it is difficult and expensive to have a planar transformer of this construction fully imbedded in the host circuit board. The heavy copper weight used in this construction may further increase the minimum trace/space of the other circuitry that is resident on the circuit board. Moreover, a multi-layer circuit board with heavy copper weight may also dramatically increase the fabrication cost of the printed circuit board.

Therefore a need exists for a transformer that is economical and at the same time exhibits desirable conversion properties.

SUMMARY

Provided in one embodiment is a transformer, the transformer comprising: at least one host board comprising internal windings, which comprise copper; external windings, which comprise copper and are connected externally, with respect to the host board, and in parallel to the internal windings, wherein the external windings are heavier than the internal windings.

Provided in another embodiment is a method converting voltages, the method comprising: converting a DC voltage input into a DC voltage output using a transformer, which transformer comprises: at least one host board comprising internal windings, which comprise copper and interleaved primary and secondary windings layers embedded in the host board, wherein the primary and secondary windings layers each comprises at least one turn; and external windings, which comprise copper and are connected externally, with respect to the host board, and in parallel to the internal windings; wherein the external windings are heavier than the internal windings.

Provided in another embodiment is a host board including a transformer. The transformer comprises internal windings, which comprise copper and interleaved primary and secondary windings layers embedded in the host board, wherein the primary and secondary windings layers each comprises multiple turns; and external windings, which comprise copper and are connected externally, with respect to the host board, and in parallel to the internal windings; wherein the external windings are heavier than the internal windings.

DETAILED DESCRIPTION

Figure 1:
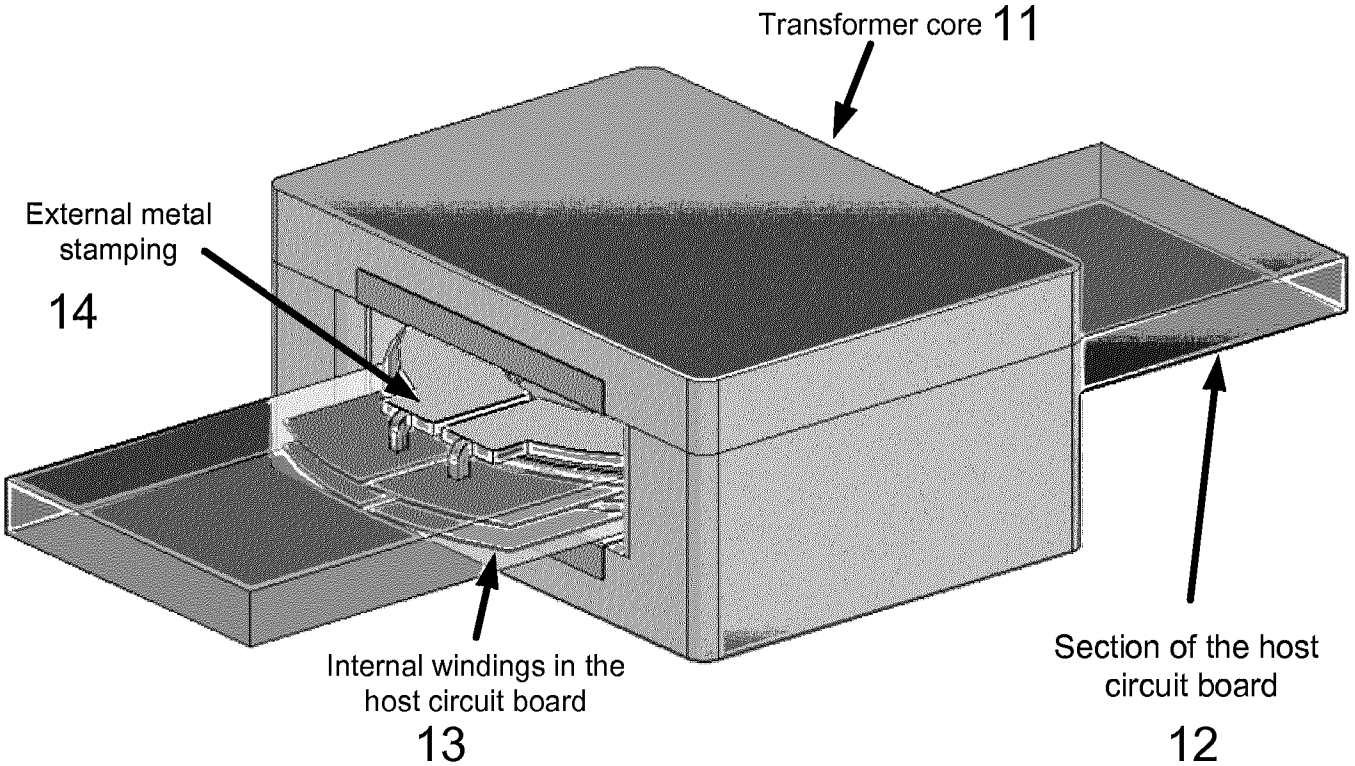
FIG. 1 provides a schematic illustration of an exemplary transformer with internal and external windings according to one embodiment.

According to one embodiment, a power circuit or other power application can use a power converter. In one embodiment, a power converter is embodied as a transformer. Transformers can be utilized in various applications. One such application includes supplying power to electronic equipment on-board an aircraft. Aircraft power supplies can be used to supply power to a variety of equipment, including but not limited to radios, computers, navigation equipment, flight controls, radar, sensors, entertainment equipment, displays, audio equipment, etc. Although aircraft applications are mentioned herein, the scope of the invention is not limited to aircraft applications or uses in aircraft applications.

One aspect of certain embodiments provided herein is related to a transformer with imbalanced copper. The transformer may include or be integrated with at least one host board containing internal windings and external windings, and the external windings may be connected in parallel to the internal windings. The terms "internal" and "external" employed herein are used in reference to the host board. In one embodiment, the host board is a board used in the power application, such as a board for an amplification circuit, a power supply board, etc.

The internal and external windings can contain at least one conductive material, such as a metal. In some embodiments, the internal and external windings may contain copper. Depending on the application, the internal and external windings may contain the same or different amounts of metal. For example, in contrast to the conventional transformer, which utilizes the same amount of metal, the transformers described herein may have internal and external windings with different amounts of metals (i.e., "imbalanced"). The term "amount" herein can refer to the mass, dimensions (e.g., thickness, height, length, width), or density. In some embodiments, the external windings may have more metal than the internal windings. In some other embodiments, the external windings may have heavier metal than the internal windings. In some other embodiments, the external windings may be thicker than the internal windings.

The host board may be, for example, a printed circuit board. The host board may comprise interleaving layers of electrically conductive materials—e.g., copper. The host board may also contain insulating dielectric layers, which may be laminated together with expoxy. The dielectric materials may include polytetrafluoroethylene (Teflon), FR-1, FR-2 (phenolic cotton paper), FR-3 (cotton paper and epoxy), FR-4 (woven glass and epoxy), FR-5 (woven glass and epoxy), FR-6 (matte glass and polyester), G-10 (woven glass and epoxy), CEM-1 (cotton paper and epoxy), CEM-2 (cotton paper and epoxy), CEM-3 (woven glass and epoxy), CEM-4 (woven glass and epoxy), and CEM-5 (woven glass and polyester).

The external windings may be a part of a metal stamping or a multi-layer circuit board, or both. The metal may refer to the same metal as or different metal from the metal used in the internal windings. The metal may be copper. In some embodiments, the external windings may be a part of an (external) multi-layer circuit board and may have any suitable number of layers. For example, the external board may have at least two layers—e.g., three, four, five, or more. The layers of the external circuit board may be connected to one another, or they can be separated by at least one insulator.

In some embodiments, the external windings are a part of a metal stamping. The stamping may have a thickness that is at least about 0.25 mm—e.g., about 0.5 mm, about 0.75 mm, or more. The stamping may contain at least one turn, which may be printed on the layer(s) of the stamping. The number of turns may be more than one—e.g., at least 2, 5, 10, 20, 50, 100, 200, 400, 600, 800, or more. In some embodiments, the external windings may have a lower resistance, and thus lower dissipation, relative to the internal windings. In some other embodiments, the external embodiments have a higher leakage inductance relative to the internal windings. The external windings are connected in parallel to the internal windings. In some embodiments, the external windings may permit switch currents at fundamental operating frequency and first few harmonics to be conducted therein. In some embodiments, "fundamental frequency" may refer to the transformer switching frequency, and the first few harmonics may refer to a frequency content that is two, three, or more, times higher in frequency magnitude than the switching frequency.

The internal windings may include a plurality of layers. The layers may include interleaved primary and secondary windings layers. Each of the primary and secondary winding layers may comprise at least one turn. The number of turns may be more than one—e.g., at least 2, 5, 10, 20, 50, 100, 200, 400, 600, 800, or more. At least some of the turns (including all of the turns) may be contained internally in the host board. Accordingly, at least some of the primary and secondary windings layers (including all of these layers) may be embedded internally in the host board. In some embodiments, the internal windings may permit switch edge related, high frequency currents to be conducted therein. In some embodiments, switch edge related currents may be currents with a frequency content that is sufficiently high in frequency to represent the sharp edges of a switching waveform. The frequency of the high frequency currents may be four, five, six, or more, times higher in frequency magnitude than the switching frequency.

FIG. 1 provides a schematic illustration of a planar transformer with internal and external windings in one embodiment. In this embodiment, the transformer includes a transformer core 11, a host (circuit) board 12, internal windings 13, and external windings 14. The internal windings may be embedded in the host circuit board, as shown in FIG. 1. The external windings may be in the form of a metal stamping, as shown in FIG. 1. In one embodiment, the external copper stamping is about 0.02 inches.

The turns of the different layers, including primary and/or secondary layers, may be connected in series or in parallel. In some embodiments, the turns of each of the primary windings layers may be connected in series or in parallel. For example, the turns of each of the primary windings layers may be connected in series.

In some embodiments, the internal windings include low copper weight layers in the host printed circuit board. The layers are employed to perform primary-secondary interleaving of the windings, and are connected in parallel to external metal stampings and/or two-layer external heavy copper weight printed circuit boards. In some embodiments, the external windings may have higher current windings relative to the internal windings. In some other embodiments, the internal windings may have higher current windings relative to the external windings.

The transformers described herein may be used to convert an input voltage of a first voltage value to an output voltage of a second value. The voltage may be DC or AC voltage. In some embodiments, the voltage for both the input and output voltage refers to DC voltage. The first value may be higher than the second value. Alternatively, the second value may be higher than the first value. The first and second voltage values may vary, depending on the applications. For example, a high voltage in one incident may refer to about 100 V to about 500 V—e.g., about 150 V to about 400 V, about 200 V to about 300 V. A medium voltage in one incident may refer to about 5 V to about 90 V—e.g., about 10 V to about 80 V, about 5 V to about 50 V. A low voltage in one incident may refer to about 0.1 V to about 5 V—e.g., about 0.8 V to about 5 V, about 1 V to about 2 V.

Figure 2:
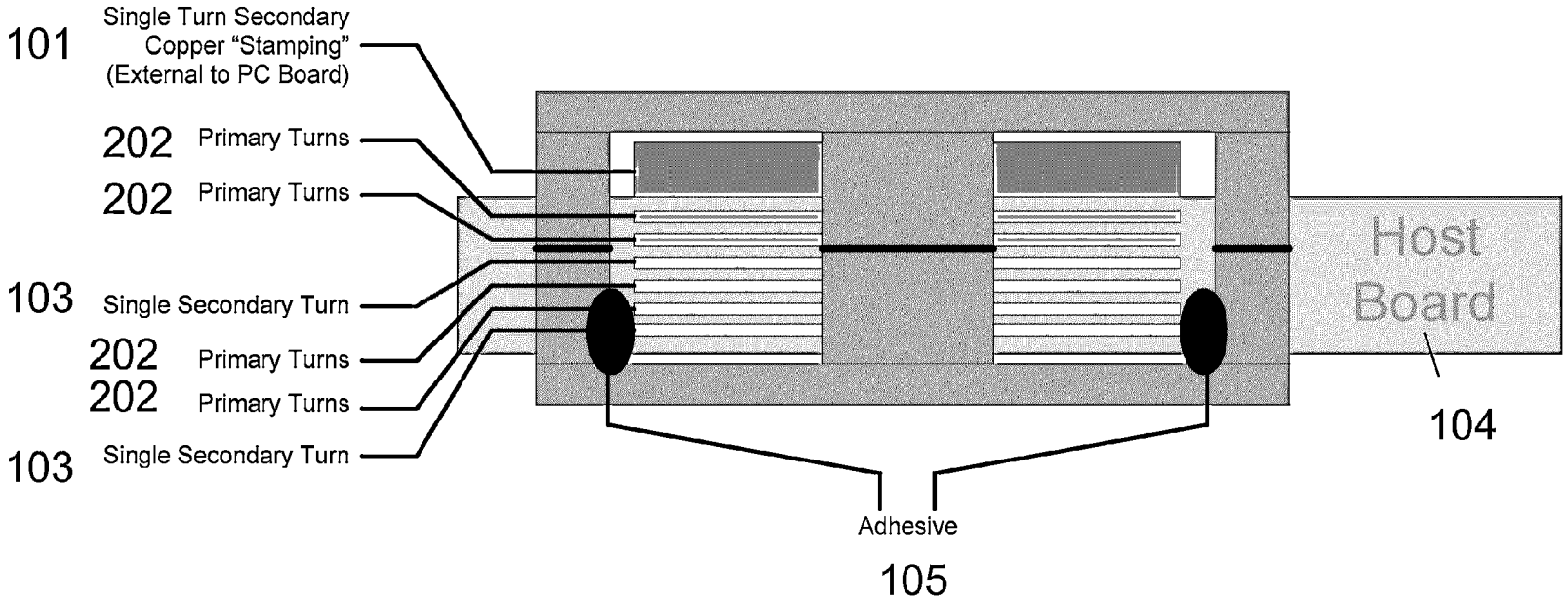
FIG. 2 provides a schematic illustration of an exemplary transformer according to one embodiment.

FIG. 2 provides a schematic illustration of an exemplary transformer according to one embodiment. The transformer described herein may be used to convert a high voltage input resulting from rectification of single or three phase AC power in the 150 V DC to 400V DC range to a low voltage output in the 0.8 V DC to 5 V DC range. In this embodiment, a single turn thick copper stamping 101 is connected in parallel with a single turn secondary windings 103 in the host board 104. Multiple primary turns 202 are printed on each primary layer. The primary turns are connected in series to provide a high primary to secondary turns ratio. Adhesive 105 may be used during the construction. This construction keeps substantially all (e.g., completely all) of the primary turns imbedded in the host board, greatly reducing the risk of shorts due to moisture intrusion. A current doubler output rectifier may be used making the non-center tap, single secondary turn ideal.

Figure 3:
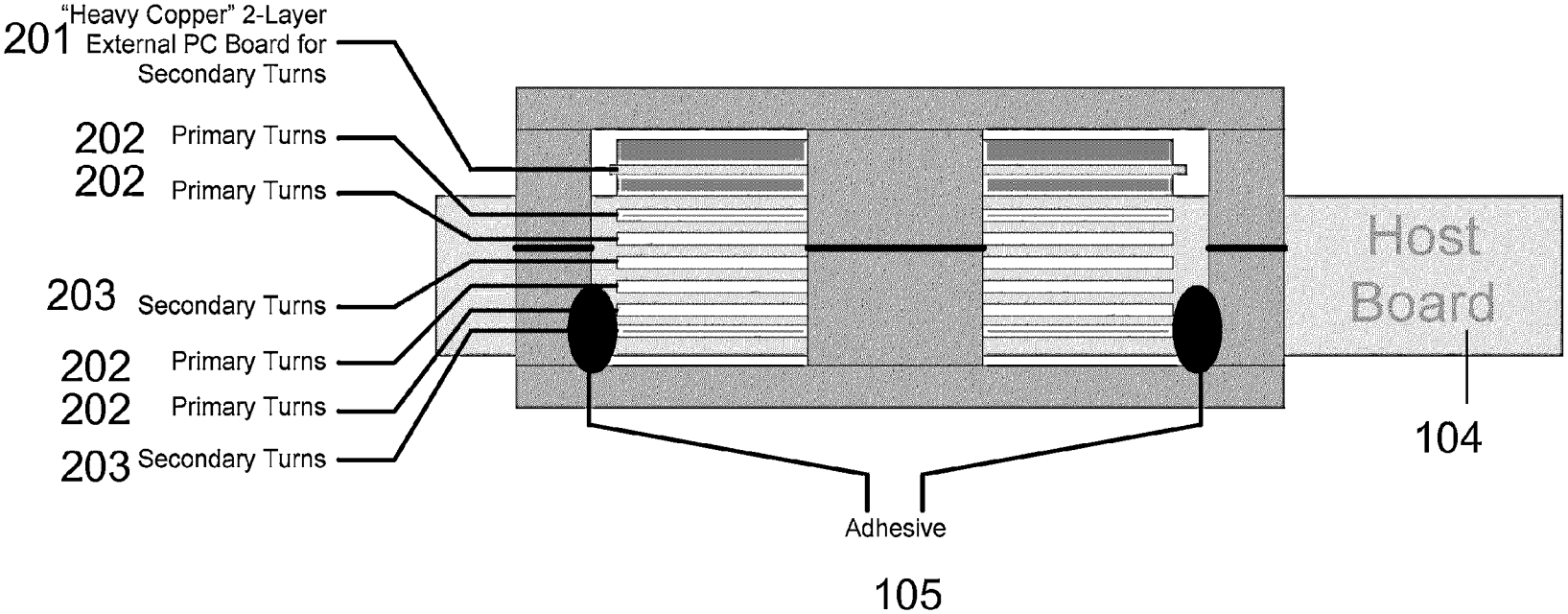
FIG. 3 provides a schematic illustration of an exemplary transformer according to one embodiment.

FIG. 3 provides a schematic illustration of an exemplary transformer according to one embodiment. The transformer described herein may be used to convert a high voltage input to a medium voltage output in the 5 V DC to 50 V DC range. In this embodiment, each primary and secondary layer has multiple turns. A supplemental, external two layer circuit board 201 with heavy copper weight is added and connected in parallel with the secondary turns 203 in the host board 104. The primary turns 202 are located internally to the host circuit board, thereby reducing the risk of shorts due to moisture intrusion.

Figure 4:
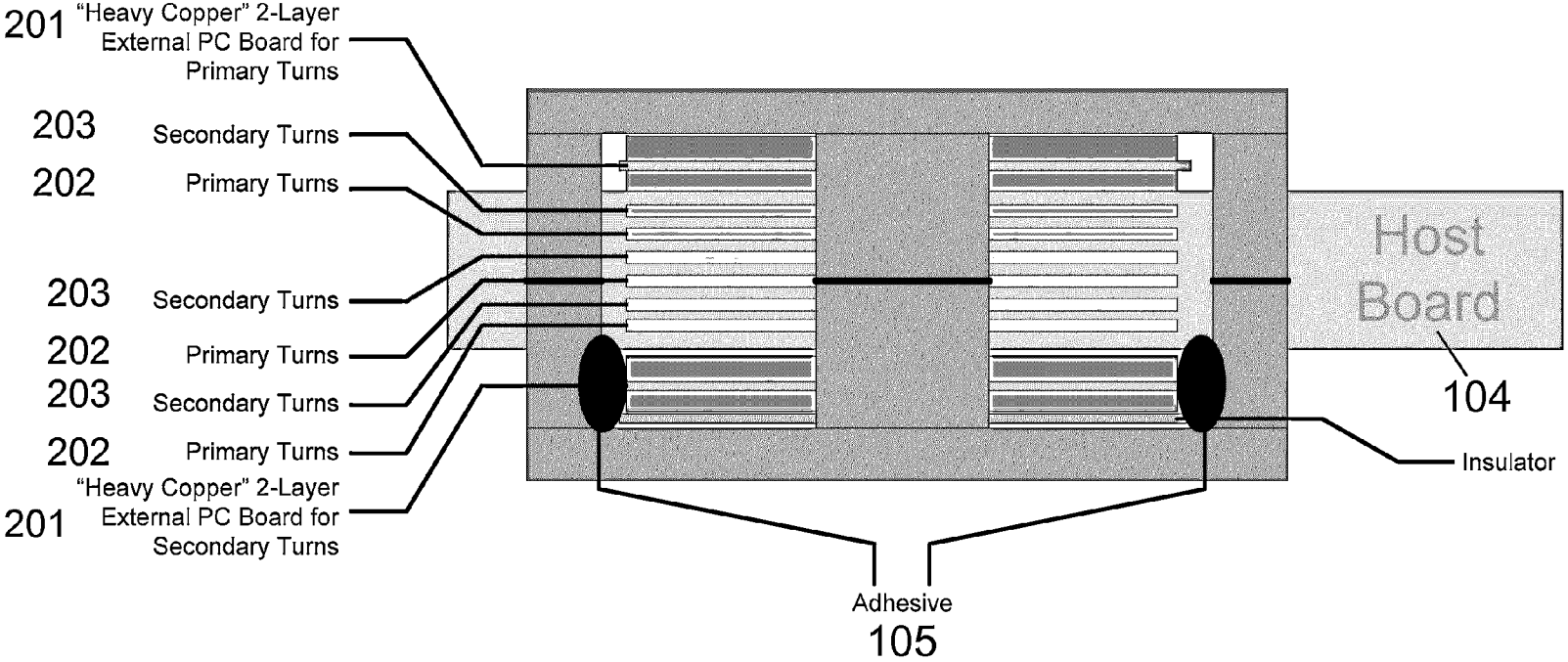
FIG. 4 provides a schematic illustration of an exemplary transformer according to one embodiment.

FIG. 4 provides a schematic illustration of an exemplary transformer according to one embodiment. The transformer described herein may be used to convert a medium voltage in the 10 V DC to 80 V DC range to a medium output voltage in the 5 V DC to 50 V DC range. This embodiment may be employed in an aviation application. For example, this embodiment may be used to convert power supplied by an aircraft at 28 V DC to a common distributed power bus voltage (e.g., 5 V DC, 12 V DC, 15 V DC or 29 V DC). Two layer supplemental, external circuit boards 201 with heavy copper are connected in parallel with the primary and secondary turns, 202 and 203, respectively, to decrease the series resistance of both.

Figure 5:
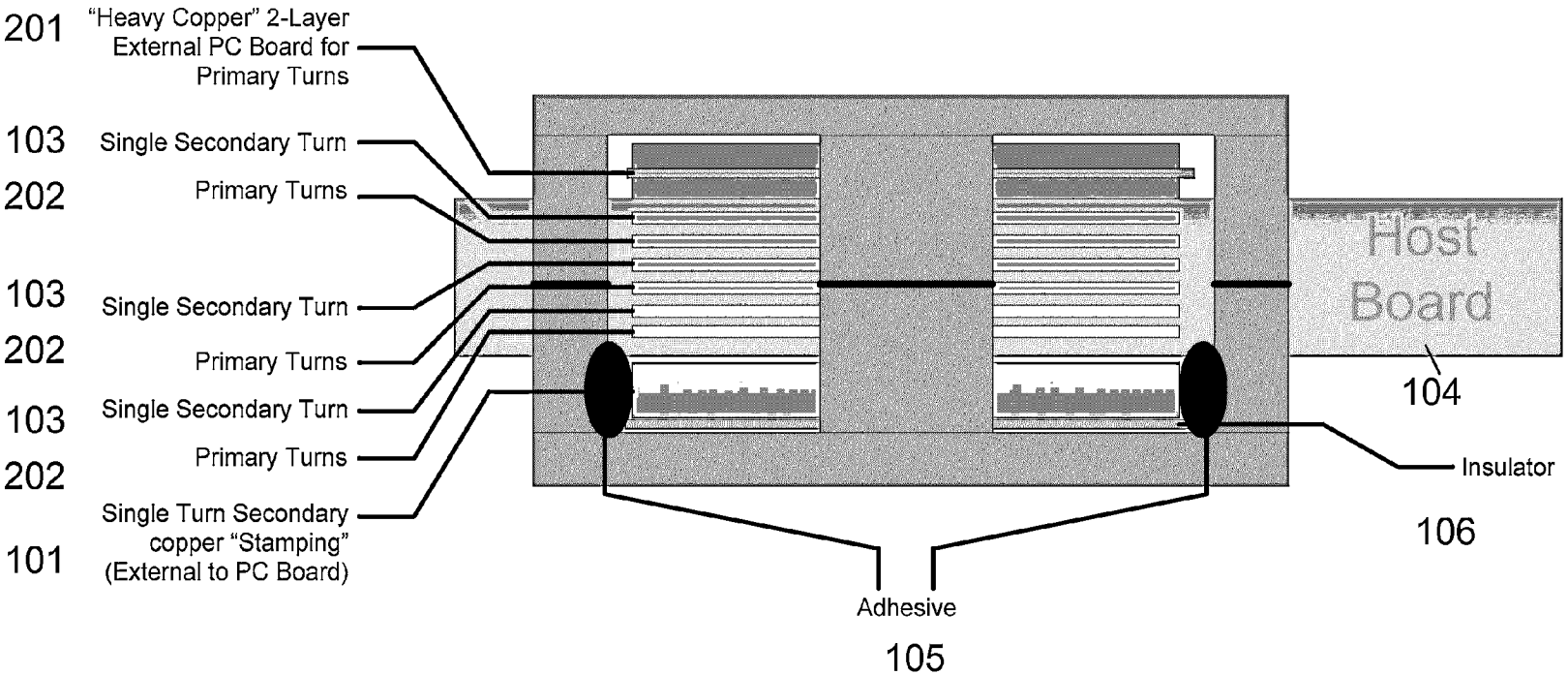
FIG. 5 provides a schematic illustration of an exemplary transformer according to one embodiment.

FIG. 5 provides a schematic illustration of an exemplary transformer according to one embodiment. The transformer described herein may be used to convert a medium voltage in the 10 V DC to 80 V DC range to a low output voltage in the 0.8 V DC to 5 V DC range. A two layer supplemental, external circuit board 201 with heavy copper is connected in parallel with the primary turns 202 in the host board 104. A single turn external copper stamping 101 is connected in parallel with the secondary single turns 103 in the host board. In this embodiment, an insulator 106 may be further applied. In this exemplary embodiment, the insulator 106 is used to electrically insulate the copper stamping from the transformer core. Depending on the construction of the transformer, an insulator may be optional.

The transformers described herein surprisingly exhibit low leakage inductance and low series resistance, in comparison to conventional transformers with equal metal weights. As a result, the transformers herein allow good high frequency performance with low dissipation. Specifically, the use of external supplemental copper surprisingly gives rise to high performance of the transformer without the need for thick copper layers in the printed wiring board. Further, the windings in the printed wiring board may be interleaved to provide low leakage inductance, while the thick external windings provide high current capability with low power loss. Because there is no need for thick copper layers in the printed wiring board, the cost of the printed wiring board in the presently described transformers is reduced, and small etch feature sizes may be implemented. This allows for a combination of high performance, low cost, compact design, and the collocation of the transformer in a printed wiring board that also contains small signal components and traces.

For example, the presently described transformers may provide a power conversion density of at least about 40 W/m^3—e.g., about 45 W/m^3, about 50 W/m^3, about 55 W/m^3, about 60 W/m^3. On the other hand, the height of the assembly of the presently described transformers may be less than about 0.7 inches—e.g., about 0.6 inches, about 0.5 inches, about 0.4 inches.

Figure 6:
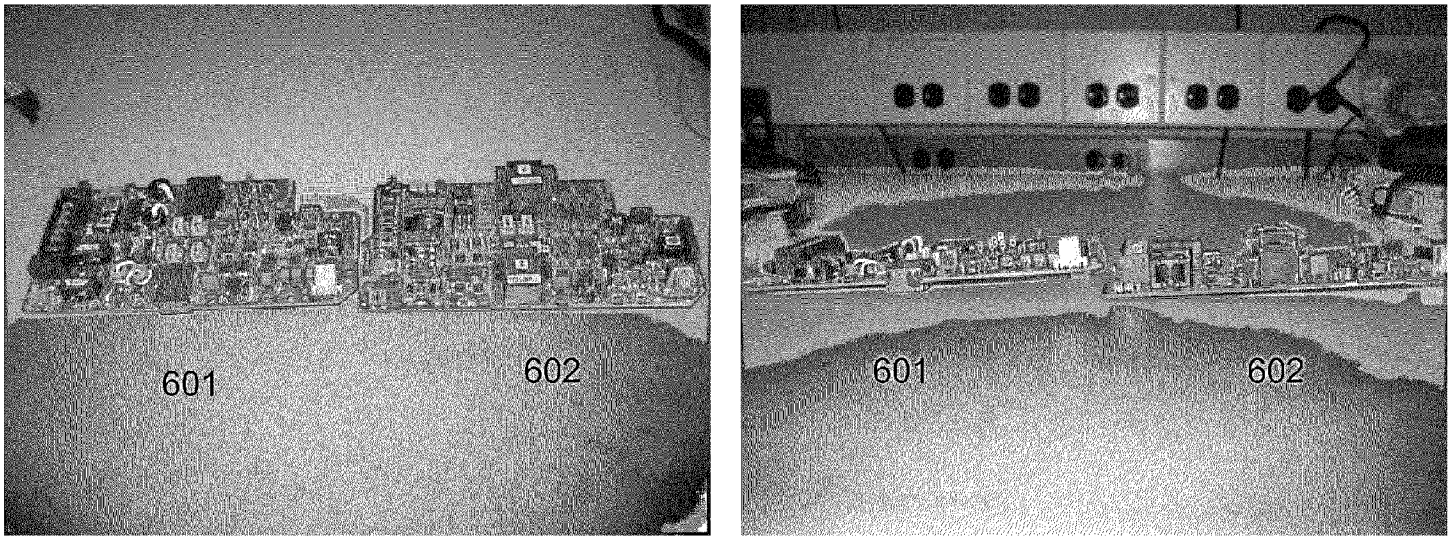
FIGS. 6(*a*)-6(*b*) provide two images contrasting, respectively, a transformer provided in one embodiment described herein ("Embedded") and a conventional transformer.

FIGS. 6(*a*)-6(*b*) provide a bird-eye view image and a side view image, respectively, contrasting a transformer provided in one embodiment described herein ("Embedded") and a conventional transformer. Specifically, the board on the left 601 has the embedded planar transformers, and the one on the right 602 has traditional external planar transformers.

The performance of the two boards provided in FIGS. 6(*a*)-6(*b*) was investigated and the results obtained therefrom are provided in Table 1 below. Both of these boards are rated for 420 Watts of power conversion. As can be seen in Table 1, the presently described transformer has much higher power conversion density and at the same time much lower height than a conventional transformer. More importantly, Table 1 shows that the presently provided transformer may have a fabrication cost savings of over 1,360% over the conventional transformer.

TABLE 1

Comparison between a presently provided transformer and a conventional transformer

| | Conventional | Embedded | % improvement |
|---|---|---|---|
| Power conversion density | 39 W/m^3 | 57 W/m^3 | 46% |
| Assembly height | 0.73 inch | 0.5 inch | 46% |
| Cost per transformer | $100 | $6.85 | 1,360% |

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

What is claimed:

1. A transformer, comprising:

at least one host board comprising internal windings, the internal windings comprising copper, the internal windings comprising a primary winding and a secondary winding; and external windings, wherein the external windings comprise copper and are separate from and are connected externally, with respect to the host board, and in parallel to the secondary winding of the internal windings, wherein the external windings are heavier than the internal windings, wherein the external windings are disposed on a copper stamping or a heavy copper two layer printed circuit board, wherein metal layers on the heavy copper two layer printed circuit board or the copper stamping have a thickness greater than a thickness of metal layers on the host board, wherein the heavy copper two layer printed circuit board or the stamping are disposed in a plane parallel to the metal layers of the host board.

2. The transformer of claim 1, wherein the external windings comprise more copper than the internal windings.

3. The transformer of claim 1, wherein the external windings disposed on the copper stamping and the heavy copper two layer printed circuit board.

4. The transformer of claim 1, wherein the internal windings have a lower leakage inductance relative to the external windings.

5. The transformer of claim 1, wherein the external windings have a lower dissipation relative to the internal windings.

6. The transformer of claim 1, wherein the internal windings comprise interleaved layers of primary and secondary windings.

7. The transformer of claim 1, wherein the internal windings permit switch edge related, high frequency currents to be conducted therein.

8. The transformer of claim 1, wherein the external windings permit switch currents at fundamental operating frequency and first few harmonics to be conducted therein.

9. The transformer of claim 1, wherein the transformer is configured to convert a DC voltage input into a DC voltage output, wherein the voltage input has a higher magnitude than the voltage output.

10. The transformer of claim 1, wherein the external windings comprise a plurality of layers, which are separated from one another by at least one insulator.

11. The transformer of claim 1, wherein the transformer is configured to convert a DC voltage input into a DC voltage output, wherein the DC voltage input is about 150 V to about 400 V and the DC voltage output is about 0.8 V to about 5 V, wherein the external windings are a part of the stamping, and wherein a single turn of the external windings in the stamping is connected in parallel to a single turn of the secondary windings embedded in the host board.

12. The transformer of claim 1, wherein the transformer comprises the heavy copper two layer printed circuit board and another the heavy copper two layer printed circuit board.

13. The transformer of claim 1, wherein the transformer is configured to convert a DC voltage input into a DC voltage output, wherein the DC voltage input is about 10 V to about 80 V and the DC voltage output is about 5 V to about 50 V, wherein the external windings are a part of the heavy copper two layer printed circuit board.

14. The transformer of claim 1, wherein the transformer is configured to convert a DC voltage input into a DC voltage output, wherein the DC voltage input is about 10 V to about 80 V and the DC voltage output is about 0.8 V to about 5 V, wherein the external windings are a part of heavy copper two layer printed circuit board and the stamping.

* * * * *